US005527178A

United States Patent [19]

White et al.

[11] Patent Number: 5,527,178

[45] Date of Patent: Jun. 18, 1996

[54] JET ASSEMBLY

[75] Inventors: Patrick A. White, Sharnford; Michael R. Perry, Kenilworth; Michael C. Quigley, Meriden, all of United Kingdom; Malcolm J. Hayhurst, Coventry; Alan Sellars, South Humberside, both of England; Alan Owens, Nuneaton; Jacqueline F. MacDonald, Henley Green, both of United Kingdom; Ralph Draper, Coventry, England

[73] Assignee: Courtaulds Fibres (Holdings) Limited, London, England

[21] Appl. No.: 66,777

[22] Filed: May 24, 1993

[51] Int. Cl.[6] ..... B29C 47/30; B29C 47/86

[52] U.S. Cl. ..... 425/192 S; 264/207; 425/378.200; 425/382.200; 425/464

[58] Field of Search ..... 425/192 S, 131.5, 425/382.200, 378.100, 72.2, 464, 378.200, DIG. 217; 264/207

[56] References Cited

U.S. PATENT DOCUMENTS

| | | | |
|---|---|---|---|
| 2,253,089 | 8/1941 | Nydegger | 425/378.2 |
| 2,369,506 | 2/1945 | Weibel | 425/378.2 |
| 2,707,306 | 5/1955 | Weber et al. | 425/382.2 |
| 2,791,802 | 5/1957 | Weber | 425/378.2 |
| 2,993,230 | 7/1961 | Henry | 425/382.2 |
| 3,354,250 | 11/1967 | Killoran et al. | 425/192 S |
| 3,406,427 | 10/1968 | Tsuji | 425/DIG. 217 |
| 3,407,437 | 10/1968 | Lenk | 425/464 |
| 3,427,685 | 2/1969 | Gove et al. | 425/464 |
| 3,437,725 | 4/1969 | Pierce | 425/378.2 |
| 3,655,314 | 4/1972 | Lenk et al. | 425/378.2 |
| 3,659,989 | 5/1972 | Uraya et al. | 425/378.2 |
| 3,752,874 | 8/1973 | Coates . | |
| 3,762,850 | 10/1973 | Werner et al. | 425/382.2 |
| 4,035,127 | 7/1977 | Ogasawara et al. | 425/192 S |
| 4,099,898 | 7/1978 | Beek | 425/378.2 |
| 4,246,221 | 1/1981 | McCorsley, III . | |
| 4,416,698 | 11/1983 | McCorsley . | |
| 4,564,350 | 1/1986 | Holmes et al. | 425/464 |
| 4,645,444 | 2/1987 | Lenk et al. | 425/192 S |
| 4,648,826 | 3/1987 | Ogasawara et al. | 425/192 S |
| 4,801,257 | 1/1989 | Lenk | 425/192 S |

FOREIGN PATENT DOCUMENTS

| | | | |
|---|---|---|---|
| 1003082 | 3/1952 | France . | |
| 2103925 | 4/1972 | France . | |
| 1250961 | 9/1967 | Germany | 425/192 S |
| 2324599 | 12/1974 | Germany | 425/378.2 |
| 223740 | 6/1985 | Germany . | |
| 629397 | 12/1961 | Italy | 425/464 |
| 4-289208 | 10/1992 | Japan | 425/464 |
| 293416 | 12/1929 | United Kingdom . | |
| 973085 | 10/1984 | United Kingdom . | |
| 2171954 | 9/1986 | United Kingdom | 425/378.28 |

OTHER PUBLICATIONS

Walczak, Z. K., "Formation of Synthetic Fibres," 293–295 (United States 1977).

English Summary to French Patent No. 1,003,082.

*Primary Examiner*—Khanh P. Nguyen

*Attorney, Agent, or Firm*—Davis Hoxie Faithfull & Hapgood

[57] ABSTRACT

A jet assembly for spinning cellulose fibres from a solution of cellulose in an amine oxide solvent in which the jet assembly includes a generally top-hat shaped spinnerette having a series of downwardly directed holes through the base of the spinnerette and an outwardly directed flange around the periphery of the vertical walls of the spinnerette, the jet assembly including a heated housing engaging with the flange and being bolted to the flange, insulation being provided on the underside of the jet assembly over the outer periphery, the combination of heating and insulation regulating the temperature of the jet assembly for optimum spinning of an amine oxide cellulose solution.

9 Claims, 3 Drawing Sheets

JET ASSEMBLY

BACKGROUND TO THE INVENTION

This invention relates to jet assemblies and has particular reference to such assemblies for the spinning of cellulose filaments from a solution of cellulose in a suitable solvent.

Cellulose may be dissolved in a tertiary amine oxide, for example by the method described in U.S. Pat. No. 4,246,221, the contents of which are incorporated herein by way of reference. Once the cellulose has been dissolved in the solvent, cellulose filaments can be prepared by spinning the solution, commonly referred to as a dope, through a spinnerette into a water bath via an air gap. The cellulose solution is processed at an elevated temperature—typically about 100° C. to 110° C.—and is supplied in the heated condition to the spinnerette for spinning purposes.

The cellulose solution is viscous and has to be pressurised to very high pressure levels—typically 100 to 200 bar for pumping purposes. The use of such high pressures means that the jet assemblies used to spin such solutions experience (as a result of pressure drops in the dope supply system) operating pressures of 30–50 bar. Even higher pressures can be experiences by the jet assembly during start up when the dope is cooler, and hence more viscous. Thus the assemblies have to be of a substantial construction, particularly if they are large and hence the forces involved are large. The jets must in practice be capable of withstanding these forces.

When producing cellulose for use as staple fibre, it is economically essential to produce large numbers of cellulose filaments simultaneously. This inevitably means that the spinning jet assemblies have to be relatively large and, therefore, the forces exerted by the pressurised cellulose become very high. It is necessary to use jet assemblies which can withstand such high forces.

SUMMARY OF THE INVENTION

By the present invention there is provided a jet assembly for the vertically downward spinning of cellulose fibres from a solution of cellulose in a solvent, the jet assembly including:

(i) a rectangular spinnerette including a vertically oriented outer wall having at its upper end an outwardly extending flange:
- (a) said outer wall defining an internal space,
- (b) at least one vertically oriented internal brace within said internal space to define a plurality of vertically extending apertures through the spinnerette,
- (c) a plurality of aperture plates welded into he bottom of the apertures, said aperture plates each having a plurality of spinning holes therethrough, said aperture plates each being welded around their entire periphery,
- (d) the lower faces of said aperture plates said at least one internal braces and said outer wall lying in a single horizontal plane.

(ii) a bottom housing having a portion lying below said outwardly directed flange of said spinnerette.

(iii) a top housing defining a chamber for the containment and passage of the solution into the spinnerette the top housing having a downwardly facing annular clamping surface.

(iv) a filter support extending across the top of the spinnerette and having a plurality of holes therethrough for the passage of solution from the chamber into the spinnerette.

(vii) a filter positioned above the filter support and supported by the filter support.

(viii) annular gasket seals between the periphery of filter support and the outer upper face of the spinnerette.

(ix) clamping means to clamp together the top and bottom housings to clamp the flange of the spinnerette and the filter therebetween.

(x) surrounding the lower portion of the spinnerette on at least one longer side and on part at least of the two shorter sides a layer of thermally insulating material extending across part at least of the lower face of the bottom housing and extending over part at least of the lower face of the spinnerette formed by the frame.

The present invention also provides a jet assembly for the spinning of cellulose fibres in a vertically downwards direction from a solution of cellulose in a solvent, the jet assembly comprising:

(i) a spinnerette of generally rectangular shape and having an outwardly directed flange at its upper end, the spinnerette having a lower face having a planar central region with spinning holes therethrough and surrounding the planar central region a lower peripheral region not containing spinning holes, (ii) a top housing having at its upper end an aperture to receive a supply of cellulose in a solution and an annular lower clamping face.

(iii) a bottom metal housing having an upwardly directed clamping face.

(iv) means to clamp the top and bottom housings together to seal the spinnerette to the top housing.

(v) an annular thermally insulating layer having a thermal conductivity lower than that of the bottom housing, the thermally insulating layer extending across the bottom housing and across at least part of at least an outer portion of the lower peripheral region of the spinnerette.

The present invention further provides a jet assembly for the spinning of a solution of cellulose in an amine oxide solvent, the jet assembly comprising:

(i) a spinnerette:
- (a) having a horizontal lower face,
- (b) a plurality of spinning holes in said horizontal lower face,
- (c) upwardly directed metal walls around the periphery of said lower face,
- (d) said upwardly extending walls defining an internal chamber for the passage of said solution therethrough, (ii) A supply line for the supply of said solution to said spinnerette, (iii) an upper housing interconnecting said supply line and said spinnerette, (iv) means to interconnect said spinnerette and said upper housing, (v) thermally insulating material surrounding some at least of said spinnerette and insulating part at least of the lower edge and lower face of said spinnerette.

BRIEF DESCRIPTION OF THE DRAWINGS

By way of example, embodiments of the present invention will now be described with reference to the accompanying drawings, of which

DESCRIPTION OF THE INVENTION

Figure 1:
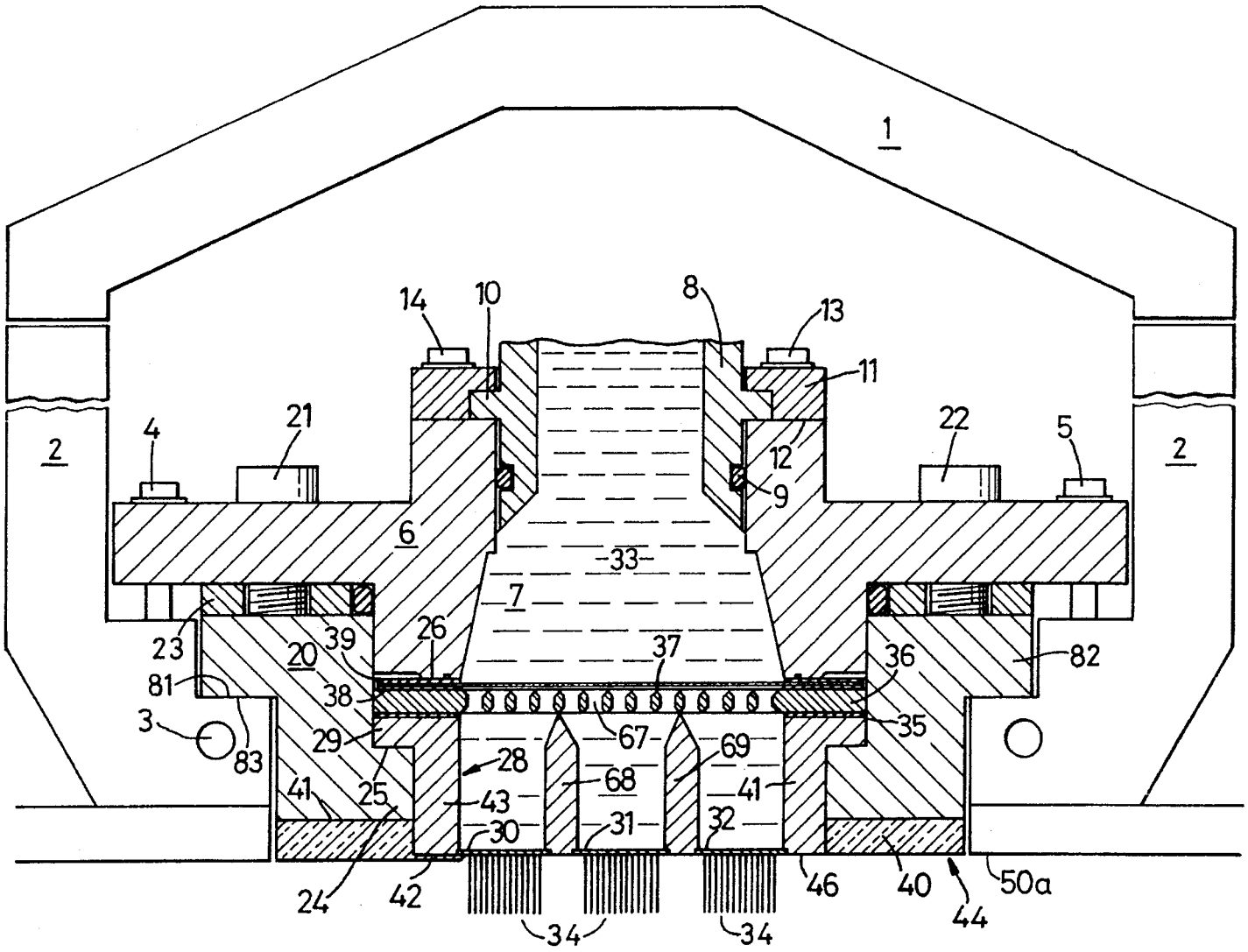
FIG. 1 is a cross sectional view along a minor axis of a jet assembly.

Referring to FIG. 1, this shows a jet assembly located within an insulating cover 1 and frame 2. The frame 2 is thermally insulated from its steel support structure, and has a bore 3 extending around the frame through which a suitable heating medium such as hot water, steam, or oil, can be passed to heat the lower end of the frame. Because the cellulose solution spun through the jet assembly is supplied to the jet assembly at an elevated temperature, typically 105° C., it is preferable to provide heating to maintain the solution at the correct temperature and to provide insulation to minimise excessive heat loss and to prevent injury to operating personnel.

Bolted to the frame 2 by means of bolts or studs 4, 5 is a top housing 6. The top housing forms an upper distribution chamber 7 into which is directed an inlet feed pipe 8. The inlet feedpipe is provided with an O-ring seal 9 and a flange 10. A locking ring 11 is bolted to the upper face 12 of the top housing 6 to trap the flange 10 to hold the inlet feedpipe on the top housing. Suitable bolts or studs 13, 14 are provided to bolt the ring 11 to the top housing 6.

Bolted to the underside of the top housing 6 is a bottom housing 20. A series of bolts 21, 22 are used to bolt the top and bottom housing together and an annular spacer 23 forms a positive stop to locate the top and bottom housings together at a predefined distance.

The bottom housing 20 has an inwardly directing flange portion 24 which has an annular upwardly directed surface 25. The upper housing 6 has an annular downwardly directing horizontal clamping face 26.

Clamped between the faces 25 and 26 is a spinnerette, a breaker plate and filter assembly. The spinnerette, shown in perspective view in FIG. 3, essentially comprises a rectangular member in plan view, having a top hat cross section and comprising an upwardly directed peripheral wall generally indicated by 28 incorporating an integral outwardly directed flange portion 29. The spinnerette incorporates a plurality of aperture plates 30, 31, 32 which contain the holes through which the solution of cellulose in amine oxide, 33 is spun or extruded to form the filaments 34.

The spinnerette construction is more clearly shown and illustrated in our co-pending patent application Ser. No. 08/066,779 PA.RCS 1-93—filed on May 24, 1993.

Located on the upper surface of the flange 29 is a gasket 35. Located on top of the gasket 35 is a breaker plate 36 which essentially comprises an apertured plate used to support a filter element 37. The filter element 37 is formed of sintered metal, and if the sintered metal has a fine pore size, the pressure drop across the filter can, in use, rupture the filter. The breaker plate 36, therefore, supports the filter in use. A pair of gaskets 38, 39 on either side of the filter completes the assembly located between the upwardly directed face 25 of the bottom housing and the downwardly directed face 26 of the top housing. By clamping the assembly together with the bolt 21, 22, the spinnerette, breaker plate and filter are held positively in position.

Located beneath the bottom housing 20 is an annular insulating ring 40 which is generally rectangular in plan shape. The annular insulating ring extends around the complete periphery of the wall 28, which wall 28 extends below the lower face 41 of the bottom housing 20. On one long side of the spinnerette, there is provided an integral extension portion 42 of the insulating ring 40 which extends below the long wall portion 43 of the peripheral wall 28. On the other long wall portion 44 of the peripheral wall 28 the insulating ring 40 does not have the integral extension portion 42, but the lower face 44 of the portion 45 of the ring 40 is in the same plane as the face 46 of the portion 41 of the peripheral wall 28 of the spinnerette.

Figure 2:
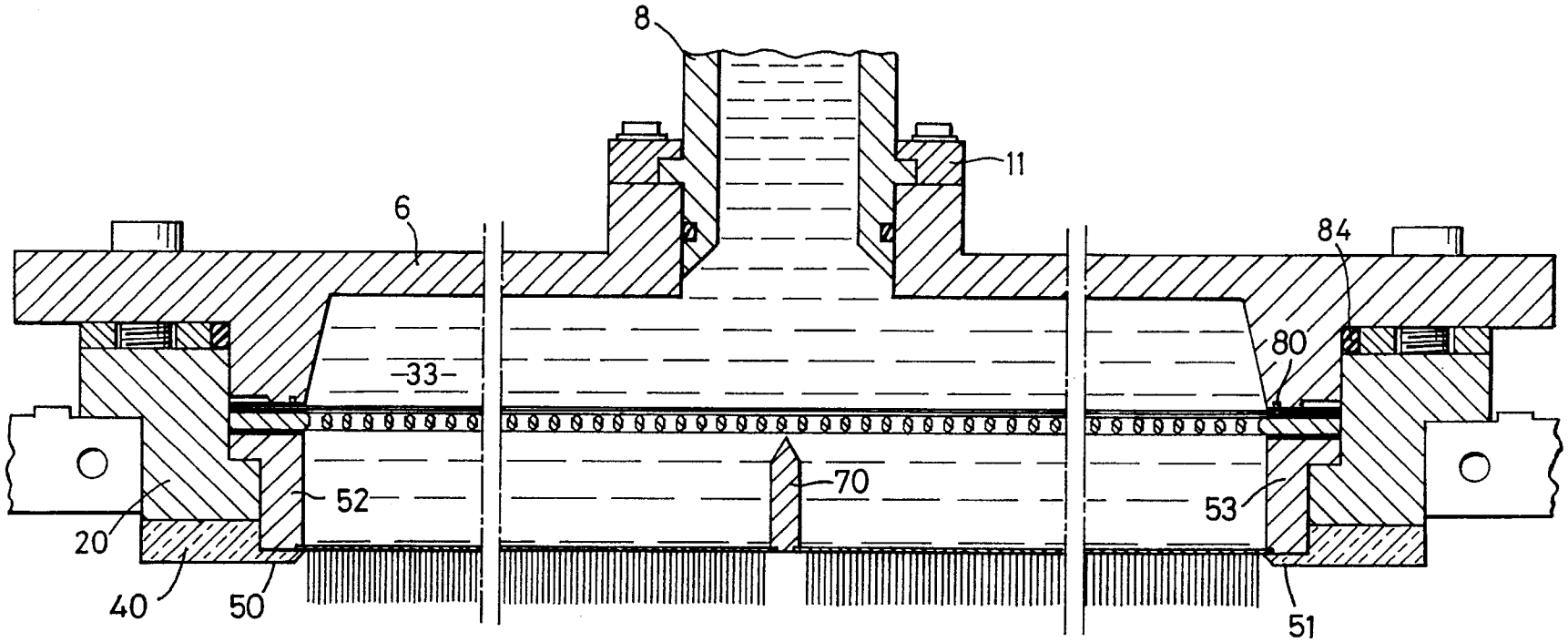
FIG. 2 is a cross section of a portion of FIG. 1 perpendicular to the section of FIG. 1.

As is more easily seen in FIG. 2, the insulating ring 40 which is secured to the underside of the bottom housing 20 by screws (not shown) has the integral extension portions 50, 51 extending over the lower faces of the portions 52, 53 of the shorter lengths of the peripheral wall 28 of the spinnerette.

Figure 3:
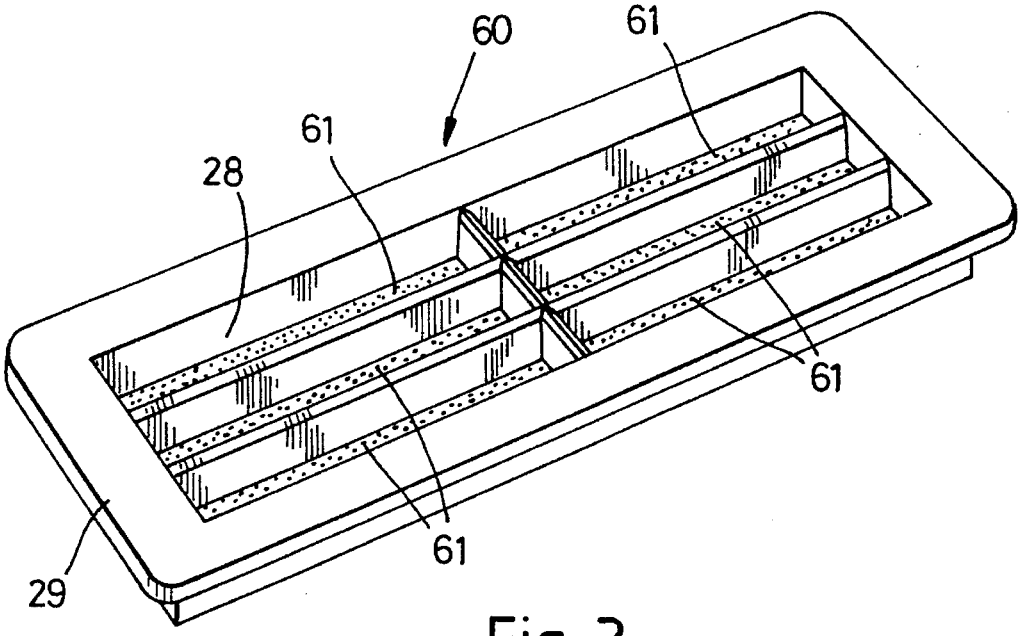
FIG. 3 is a perspective view of a spinnerette.

Referring to FIG. 3 this shows in perspective the spinnerette incorporated into the jet assembly. The spinnerette, generally 60, has an outer flange 29 integral with the wall 28. The rectangular nature of the spinnerette can clearly be seen from the perspective view in FIG. 3. The minor axis of the spinnerette is shown in the sectional view of FIG. 1 and the major axis is shown in sectional view in FIG. 2. Welded into the bottom of the spinnerette are six aperture plates 61 which three of the plates 30, 31, 32 seen in sectional view figure of FIG. 1. These plates contain the actual holes through which the cellulose solution is extruded. The spinnerette has an underside in a single plane and is capable of withstanding the high extrusion pressures experiences in spinning a hot cellulose solution in amine oxide.

Figure 4:
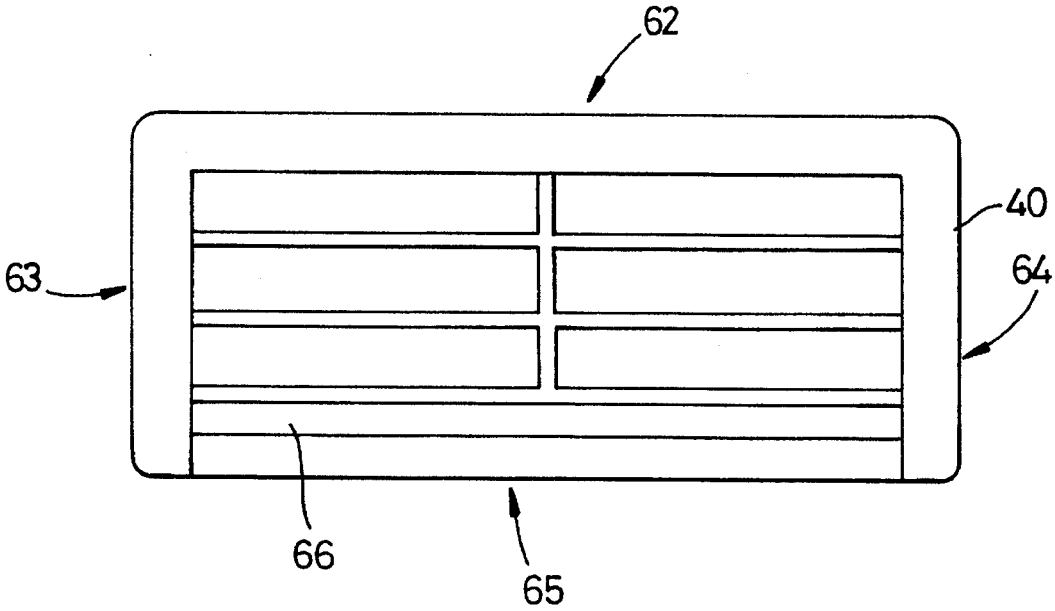
FIG. 4 is an underneath plan view of the spinnerette and insulation.

FIG. 4, is an underneath view of the spinnerette showing the location of the insulating annular member 40. It can be seen that the insulating layer, typically formed of a resin impregnated paper material such as Tufnol (trade mark) extends below the lower portion of the peripheral wall 28 on three sides of the spinnerette. Thus, seen from below, on sides 62, 63 and 64, the lower portion of the wall 28 is obscured by the extension portions in the insulating layer shown as 42, 50*a* and 51 in FIGS. 1 and 2. However, on the fourth side, side 65, the lower portion 66 of the wall 28 of the spinnerette 60 is not insulated and is, therefore exposed. The insulating annulus, therefore, is effectively surrounding the spinnerette completely and extends on three sides beneath the peripheral wall of the wall of the spinnerette.

It will be noted that the breaker plate 36 has tapered holes 67 which enhance the flow of viscous cellulose solution through the jet assembly whilst providing a good support for the filter 32. In turn the breaker plate 31 is supported by the upper edges of the internal bracing members or spars 68, 69, 70. The upper edges of the internal bracing members or spars may be displaced from the centre line of the members or spars so that the entrance area above each aperture plate is equal.

The facings 25, 26 of the housing and/or the breaker plate 36 may be provided with small recesses such as recess 80 so as to permit the gasket to be extruded into the recess to enhance sealing when the bolts holding the top and the bottom housing together are tightened. An O-ring 84 may be provided between the top and bottom housing to act as a second seal in the event of failure of the main seals between the top and bottom housing and the breaker plate and filter assembly.

The jet assembly of the invention is, therefore, capable of handling highly viscous high pressure cellulose solution in which typically the pressure of the solution upstream of the filter may be in the range 50 to 200 bar and the pressure at the jet face may be in the range 20 to 100 bar. The filter itself contributes to a significant amount of pressure drop through the system whilst in operation.

The assembly of the invention also provides a suitable heat path whereby the temperature of the dope in the jet can be maintained close to the ideal temperature for spinning for extrusion purposes. The bottom housing 20 is in firm positive contact with the spinnerette through its annular upwardly directed face 25. The bolts or set screws 22 ensure a firm positive contact. Similarly, the bolts 4,5 positively ensure that the bottom housing 20 is held tightly to the frame member 22 via its downwardly directed face 81 on an outwardly directed flange portion 82. The face 81 is in positive contact with the upwardly directed face 83 of the housing 2.

By providing a heating element in the form of a heating tube 3 directly below the face 83 there is a direct flow path for heat from the heating medium in the bore 3 into the spinnerette. It can be seen that heat can flow through the faces 83, 81 which, as mentioned above, are held into positive contact by set screws 4, 5. Heat can then flow through the bottom housing 20 via the face 25 and flange 29 into the spinnerette wall 28.

It will readily be appreciated that assemblies of the type illustrated in the drawings of the present application are normally assembled in an ambient temperature workshop. Thus typically the top and bottom housing, the spinnerette, the breaker plate and filter plate assembly will be bolted up at ambient temperature by bolting down the screws 21, 22. To enable the spinnerette to be inserted into the bottom housing 20 there needs to be a sufficient gap between the peripheral wall 28 and the interior hole of the bottom housing 20 which permits the spinnerette to be inserted and removed. It will also be appreciated that in use the assembly is heated to typically 100° C. The combination of heating and internal pressure means that there will be an unregulated expansion of the assembly. All of this means that it is not possible to rely upon a direct heat transfer sideways from the lower portion of the bottom housing directly horizontally into the side of the peripheral wall 28.

Similar constraints apply to the direct horizontal transfer into the outer side wall of the bottom housing 20 directly from the heated lower portion of the frame 2. However, by providing for a positive clamped face-to-face surface such as surface 81, 83, a positive route for the transfer of heat from the medium within bore 3 to the spinnerette is provided. Any suitable heating medium such as hot water, steam or heated oil can be passed through the bore 3.

The provision of the lower insulation 40 whilst not needed from a safety to personnel view point ensures that the heat from the hot cellulose solution itself is passed into the jet assembly from the bore 3 and does not escape through the lower face of the bottom housing.

It will readily be appreciated that the components of the jet assembly should be manufactured from material capable of withstanding any solvent solution passed through it. Thus, for example, the jet may be made from stainless steel and the housings may be made from stainless steel or castings of cast iron as appropriate. The gaskets may be formed of PTFE.

We claim:

1. A jet assembly for the vertically downward spinning of cellulose fibres from a solution of cellulose in a solvent, the jet assembly including:

(i) a spinnerette of rectangular plan shape including a vertically oriented outer wall having at and surrounding its upper end an outwardly extending flange:

(a) said outer wall defining an internal space, (b) at least one vertically oriented internal brace within said internal space to define a plurality of vertically extending apertures through the spinnerette, (c) a plurality of aperture plates welded into the bottom of the apertures, said aperture plates each having a plurality of spinning holes therethrough, said aperture plates each being welded around their entire periphery, (d) the lower faces of said aperture plates, said at least one internal brace and said outer wall lying in a single horizontal plane, (ii) a bottom housing having a portion lying below said outwardly directed flange of said spinnerette, (iii) a top housing defining a chamber for the containment and passage of the solution into the spinnerette the top housing having a downwardly facing annular clamping surface, (iv) a filter support extending across the top of the spinnerette and having a plurality of holes therethrough for the passage of solution from the chamber into the spinnerette, (v) a filter positioned above the filter support and supported by the filter support, (vi) annular gasket seals between the periphery of filter support and the outer upper face of the spinnerette, (vii) clamping means to clamp together the top and bottom housings to clamp the flange of the spinnerette and the filter therebetween, (viii) heating means to supply heat to the side walls of the spinnerette via the outwardly directed flange, and (ix) surrounding the lower portion of the spinnerette on at least one longer side and on part at least of the two shorter sides, a layer of thermally insulating material extending across part at least of the lower face of the bottom housing and extending over part at least of the lower face of the spinnerette formed by the frame.

2. A jet assembly for the spinning of cellulose fibres in a vertically downwards direction from a solution of cellulose in a solvent, the jet assembly comprising:

(i) a spinnerette of generally rectangular plan shape and having an outwardly directed flange at and surrounding its upper end, the spinnerette having a lower face having a planar central region with spinning holes therethrough and surrounding the planar central region a lower peripheral region not containing spinning holes, (ii) a top housing having at its upper end an aperture to receive a supply of cellulose in a solution and an annular lower clamping face, (iii) a bottom metal housing having an upwardly directed clamping face, (iv) heating means to heat the bottom metal housing, (v) means positively to clamp the top and bottom housings together to seal the spinnerette via its flange to the top housing to provide a heat transfer pathway from the bottom metal housing to the spinnerette, and (vi) an annular thermally insulating layer having a thermal conductivity lower than that of the bottom housing the thermally insulating layer extending across the bottom housing and across at least part of at least an outer portion of the lower peripheral region of the spinnerette.

3. A jet assembly for the spinning of a solution of cellulose in an amine oxide solvent, the jet assembly comprising:

(i) a spinnerette of rectangular plan form:
(a) having a horizontal lower face,
(b) a plurality of spinning holes in said horizontal lower face,
(c) upwardly directed metal walls around the periphery of said lower face,
(d) said upwardly extending walls defining an internal chamber for the passage of said solution therethrough,
(e) an outwardly extending flange at and surrounding the upper end of said upwardly extending walls, (ii) a supply line for the supply of said solution to said spinnerette, (iii) an upper housing interconnecting said supply line and said spinnerette, (iv) means to interconnect said spinnerette and said upper housing, (v) thermally insulating material surrounding some at least of said spinnerette and insulating part at least of the lower edge and lower face of said spinnerette, (vi) heating means for the spinnerette, (vii) said heating means heating the spinnerette via its flange and a bottom housing, the bottom housing being bolted to said top housing and clamping said spinnerette therebetween.

4. A jet assembly as claimed in claim 3 in which the heating means comprises a fluid filled heating conduit.

5. A jet assembly as claimed in claim 4 in which said fluid is selected from the group, steam, hot water and oil.

6. A jet assembly as claimed in claim 3 in which the thermal insulation is located beneath three sides only of said spinnerette.

7. A jet assembly as claimed in claim 1 in which said lower housing is bolted to a support and said support incorporates an internal passageway for a heating medium.

8. A jet assembly for the spinning of a solution of cellulose in an amine oxide solvent, the jet assembly comprising (i) a spinnerette of rectangular plan shape having
(a) a horizontal aperture plate having a central region,
(b) a plurality of spinning holes in the central region of said horizontal aperture plate extending through to a lower face thereof,
(c) an external framework surrounding said horizontal aperture plate and having an underside,
(d) an outwardly extending flange of rectangular plan shape integral with said external framework, (ii) heating means including a metallic heated member, (iii) a plurality of mechanical clamping means located around said spinnerette to clamp together said heating means and said flange, and (iv) thermal insulating means insulating at least some of the underside of said external framework and said aperture plate, the lower face of the central region of said aperture plate being insulation free.

9. A jet assembly as claimed in claim 8 in which the mechanical clamping means comprise bolts.

* * * * *